US012660858B2

(12) United States Patent
Rothwell et al.

(10) Patent No.: US 12,660,858 B2
(45) Date of Patent: Jun. 23, 2026

(54) ARTICLE FOR AN AEROSOL PROVISION SYSTEM

(71) Applicant: Nicoventures Trading Limited, London (GB)

(72) Inventors: Howard Rothwell, London (GB); Mohammed Al-Amin, London (GB)

(73) Assignee: Nicoventures Trading Limited, London (GB)

( * ) Notice: Subject to any disclaimer, the term of this patent is extended or adjusted under 35 U.S.C. 154(b) by 439 days.

(21) Appl. No.: 18/250,116

(22) PCT Filed: Oct. 22, 2021

(86) PCT No.: PCT/GB2021/052736
§ 371 (c)(1),
(2) Date: Apr. 21, 2023

(87) PCT Pub. No.: WO2022/084686
PCT Pub. Date: Apr. 28, 2022

(65) Prior Publication Data

US 2023/0380508 A1 Nov. 30, 2023

(30) Foreign Application Priority Data

| | | |
|---|---|---|
| Oct. 22, 2020 | (GB) | 2016760 |
| Dec. 2, 2020 | (GB) | 2019001 |
| Sep. 22, 2021 | (GB) | 2113501 |

(51) Int. Cl.
*A24F 40/53* (2020.01)
*A24F 40/10* (2020.01)

(52) U.S. Cl.
CPC ..... *A24F 40/53* (2020.01); *A24F 40/10* (2020.01)

(58) Field of Classification Search
CPC ..... A24F 40/00; A24F 40/42; A24F 40/20; A24F 40/10; A24F 40/53; A24F 40/50
See application file for complete search history.

(56) References Cited

U.S. PATENT DOCUMENTS

| | | | | |
|---|---|---|---|---|
| 2015/0245654 | A1 | 9/2015 | Memari et al. | |
| 2017/0215485 | A1* | 8/2017 | Zitzke | A24F 40/53 |
| 2017/0224022 | A1 | 8/2017 | Liu | |
| 2018/0020729 | A1* | 1/2018 | Alarcon | A24F 40/53 392/404 |

(Continued)

FOREIGN PATENT DOCUMENTS

| | | | |
|---|---|---|---|
| EP | 3680735 | A1 | 7/2020 |
| WO | 2016154815 | A1 | 10/2016 |

(Continued)

OTHER PUBLICATIONS

"International Search Report and Written Opinion received for PCT Patent Application No. PCT/GB2021/052736, mailed on Mar. 18, 2022", 14 pages.

(Continued)

*Primary Examiner* — Cedrick S Williams
(74) *Attorney, Agent, or Firm* — Merchant & Gould P.C.

(57) ABSTRACT

An article for an aerosol provision system includes an aerosol generator and article control circuitry configured to control electrical power supplied to the aerosol generator based on a value of a counter stored in memory of the article control circuitry.

17 Claims, 10 Drawing Sheets

(56) References Cited

U.S. PATENT DOCUMENTS

| | | | | |
|---|---|---|---|---|
| 2018/0242638 | A1* | 8/2018 | Godfrey | A24F 40/50 |
| 2018/0368474 | A1 | 12/2018 | Bache et al. | |
| 2022/0378108 | A1* | 12/2022 | Cho | H05B 1/02 |
| 2024/0381922 | A1* | 11/2024 | Bilat | A24F 40/40 |
| 2025/0160429 | A1* | 5/2025 | Gretton | A24F 40/65 |

FOREIGN PATENT DOCUMENTS

| | | | |
|---|---|---|---|
| WO | 2020074929 | A1 | 4/2020 |
| WO | 2021071203 | A1 | 4/2021 |

OTHER PUBLICATIONS

"Search Report received for Great Britain Patent Application No. 2019001.3, mailed on May 18, 2021", 4 pages.

* cited by examiner

ARTICLE FOR AN AEROSOL PROVISION SYSTEM

PRIORITY CLAIM

The present application is a National Phase entry of PCT Application No. PCT/GB2021/052736, filed Oct. 22, 2021, which claims priority from GB Application No. 2016760.7, filed Oct. 22, 2020 and GB Application No. 2019001.3, filed Dec. 2, 2020 and GB Application No. 2113501.7, filed Sep. 22, 2021, and each of which hereby fully incorporated herein by reference.

TECHNICAL FIELD

The present disclosure relates to an article for an aerosol provision system, an aerosol provision system comprising the article, a method of controlling an article for an aerosol provision device and a method of controlling an aerosol generator of an article for an aerosol provision device.

BACKGROUND

Electronic aerosol provision systems such as electronic cigarettes (e-cigarettes) generally contain an aerosol-generating material, such as a reservoir of a source liquid containing a formulation, typically including nicotine, or a solid material such as a tobacco-based product, from which an aerosol is generated for inhalation by a user, for example through heat vaporization. Thus, an aerosol provision system will typically comprise an aerosol generator, e.g. a heating element, arranged to aerosolize a portion of aerosol-generating material to generate an aerosol in an aerosol generation region of an air channel through the aerosol provision system. As a user inhales on the device and electrical power is supplied to the aerosol generator, air is drawn into the device through one or more inlet holes and along the air channel to the aerosol generation region, where the air mixes with the vaporized aerosol generator and forms a condensation aerosol. The air drawn through the aerosol generation region continues along the air channel to a mouthpiece, carrying some of the aerosol with it, and out through the mouthpiece for inhalation by the user.

It is common for aerosol provision systems to comprise a modular assembly, often having two main functional parts, namely an aerosol provision device and an article. Typically the article will comprise the consumable aerosol-generating material and the aerosol generator (heating element), while the aerosol provision device part will comprise longer-life items, such as a rechargeable battery, device control circuitry and user interface features. The aerosol provision device may also be referred to as a reusable part or battery section and the article may also be referred to as a consumable, disposable/replaceable part, cartridge or cartomizer.

The aerosol provision device and article are mechanically coupled together at an interface for use, for example using a screw thread, bayonet, latched or friction fit fixing. When the aerosol-generating material in an article has been exhausted, or the user wishes to switch to a different article having a different aerosol-generating material, the article may be removed from the aerosol provision device and a replacement article may be attached to the device in its place. Alternatively, some articles are configured such that, after the aerosol-generating material in the article has been exhausted, the article can be refilled with more aerosol-generating material, thereby allowing the article to be reused. In this example, the user is able to refill the article using a separate reservoir of aerosol-generating material. The aerosol-generating material used to refill the article may be the same or different to the previous aerosol-generating material in the article, thereby allowing the user to change to a different aerosol-generating material without purchasing a new article.

Refilling the article with aerosol-generating material extends the life of the article as its use is no longer limited by the volume or amount of aerosol-generating material that the article can hold. As a result, the use of the article may be limited by other factors, such as the life of individual components within the article. Continuous use of the article may therefore result in degradation or fault developing in components within the article. The article may therefore become less reliable, the operation of the article less predictable or the article may stop working entirely, each of which has a negative impact on the user experience.

Various approaches are described herein which seek to help address or mitigate some of the issues discussed above.

SUMMARY

In accordance with some embodiments described herein, there is provided an article for an aerosol provision system comprising an aerosol generator and article control circuitry configured to control electrical power supplied to the aerosol generator based on a value of a counter stored in memory of the article control circuitry.

An initial value of the counter can indicate that the article is new, and the article control circuitry can be configured to prevent electrical power from being supplied to the aerosol generator in response to determining that the value of the counter equals the initial value.

The article control circuitry can be configured to update the value of the counter to a reset value in response to the article being filled aerosol-generating material, and the article control circuitry can be configured to enable the supply of electrical power to the aerosol generator in response to the value of the counter being updated to the reset value.

The article control circuitry can be configured to update the value of the counter in response to an inhalation on the aerosol provision system by a user of the aerosol provision system.

The article control circuitry can be configured to prevent electrical power from being supplied to the aerosol generator based on a comparison between the value of the counter and an inhalation limit.

There may be a second counter stored in memory of the article control circuitry, and the article control circuitry can be configured to update a value of the second counter in response to an inhalation on the aerosol provision system by a user of the aerosol provision system. The article control circuitry can maintain the value of the second counter in response to the article being filled aerosol-generating material, and the article control circuitry can permanently prevent electrical power from being supplied to the aerosol generator based on a comparison between the value of the second counter and a usage limit.

The article may also comprise a switch, and the article control circuitry can be configured to control electrical power supplied to the aerosol generator by actuating the switch. The switch may be integrated into the article control circuitry.

In accordance with some embodiments described herein, there is provided an aerosol provision system comprising the article described herein. The aerosol provision system can also comprise an aerosol provision device.

In accordance with some embodiments described herein, there is provided a method of controlling an article for an aerosol provision system comprising controlling electrical power supplied to an aerosol generator based on a value of a counter.

The method can also involve preventing electrical power from being supplied to the aerosol generator in response to determining that the value of the counter equals the initial value, wherein the initial value of the counter indicates that the article is new.

The method can also involve updating the value of the counter to a reset value in response to the article being filled aerosol-generating material, and enabling the supply of electrical power to the aerosol generator in response to the value of the counter being updated to the reset value.

The method can also involve updating the value of the counter in response to an inhalation on the aerosol provision system by a user of the aerosol provision system.

The method can also involve preventing electrical power from being supplied to the aerosol generator based on a comparison between the value of the counter and an inhalation limit.

In accordance with some embodiments described herein, there is provided a method of controlling an aerosol generator of an article for an aerosol provision system comprising receiving electrical power from a device coupled to the article, reading a value of a counter, and determining, based on the value of the counter, whether to enable the supply of electrical power to the aerosol generator from the device.

There is also provided a computer readable storage medium comprising instructions which, when executed by a processor, performs the above methods.

These aspects and other aspects will be apparent from the following detailed description. In this regard, particular sections of the description are not to be read in isolation from other sections.

BRIEF DESCRIPTION OF DRAWINGS

Embodiments of the present disclosure will now be described, by way of example only, with reference to accompanying drawings, in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of articles and systems discussed herein which are not described in detail may be implemented in accordance with any conventional techniques for implementing such aspects and features.

The present disclosure relates to aerosol provision systems, which may also be referred to as aerosol provision systems, such as e-cigarettes. Throughout the following description the term "e-cigarette" or "electronic cigarette" may sometimes be used, but it will be appreciated this term may be used interchangeably with aerosol provision system and electronic aerosol provision system.

As noted above, aerosol provision systems (e-cigarettes) often comprise a modular assembly including both a reusable part (aerosol provision device) and a replaceable (disposable) or refillable cartridge part, referred to as an article. Systems conforming to this type of two-part modular configuration may generally be referred to as two-part systems or devices. It is also common for electronic cigarettes to have a generally elongate shape. For the sake of providing a concrete example, certain embodiments of the disclosure described herein comprise this kind of generally elongate two-part system employing refillable cartridges. However, it will be appreciated the underlying principles described herein may equally be adopted for other electronic cigarette configurations, for example modular systems comprising more than two parts, as devices conforming to other overall shapes, for example based on so-called box-mod high performance devices that typically have a more boxy shape.

As described above, the present disclosure relates to (but it not limited to) articles of aerosol provision systems, such as e-cigarettes and electronic cigarettes.

Figure 1:
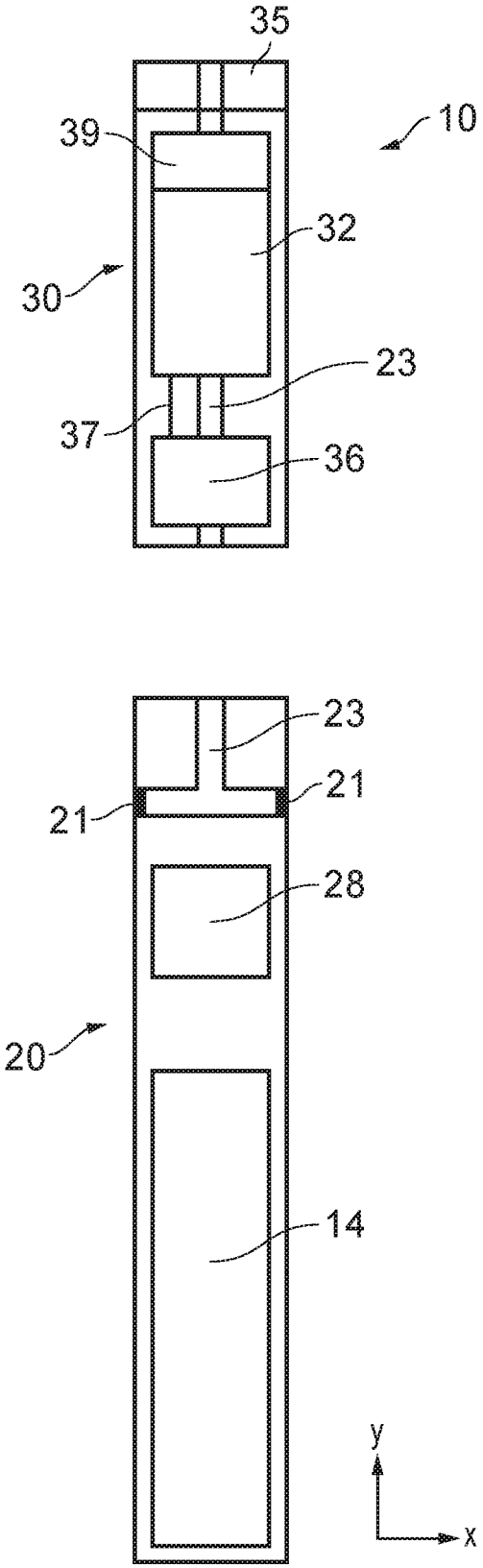
FIG. 1 is a schematic diagram of an aerosol provision system.

FIG. 1 is a highly schematic diagram (not to scale) of an example aerosol provision system 10, such as an e-cigarette, to which embodiments are applicable. The aerosol provision system 10 has a generally cylindrical shape, extending along a longitudinal or y axis as indicated by the axes (although aspects of the disclosure are applicable to e-cigarettes configured in other shapes and arrangements), and comprises two main components, namely an aerosol provision device 20 and an article 30.

The article 30 comprises or consists of aerosol-generating material 32, part or all of which is intended to be consumed during use by a user. An article 30 may comprise one or more other components, such as an aerosol-generating material storage area 39, an aerosol-generating material transfer component 37, an aerosol generation area, a housing, a wrapper, a mouthpiece a filter and/or an aerosol-modifying agent.

An article 30 may also comprise an aerosol generator 36, such as a heating element, that emits heat to cause the aerosol-generating material 32 to generate aerosol in use. The aerosol generator 36 may, for example, comprise combustible material, a material heatable by electrical conduction, or a susceptor. It should be noted that it is possible for the aerosol generator 36 to be part of the aerosol provision device 20 and the article 30 then may comprise the aerosol-generating material storage area 39 for the aerosol-generating material 32 such that, when the article 30 is coupled with the aerosol provision device 20, the aerosol-generating material 32 can be transferred to the aerosol generator 36 in the aerosol provision device 20.

Aerosol-generating material is a material that is capable of generating aerosol, for example when heated, irradiated or energized in any other way. The aerosol-generating material 32 may, for example, be in the form of a solid, liquid or gel which may or may not contain an active substance and/or flavorants. In some embodiments, the aerosol-generating material 32 may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material 32 may for example comprise from about 50 wt %, 60 wt % or 70 wt % of amorphous solid, to about 90 wt %, 95 wt % or 100 wt % of amorphous solid.

The aerosol-generating material comprises one or more ingredients, such as one or more active substances and/or flavorants, one or more aerosol-former materials, and optionally one or more other functional materials such as pH regulators, coloring agents, preservatives, binders, fillers, stabilizers, and/or antioxidants.

The active substance as used herein may be a physiologically active material, which is a material intended to achieve or enhance a physiological response. The active substance may for example be selected from nutraceuticals, nootropics, and psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

The aerosol provision device 20 includes a power source 14, such as a battery, configured to supply electrical power to the aerosol generator 36. The power source 14 in this example is rechargeable and may be of a conventional type, for example of the kind normally used in electronic cigarettes and other applications requiring provision of relatively high currents over relatively short periods. The battery 14 may be recharged through the charging port (not illustrated), which may, for example, comprise a USB connector.

The aerosol provision device 20 includes device control circuitry 28 configured to control the operation of the aerosol provision system 10 and provide conventional operating functions in line with the established techniques for controlling aerosol provision systems such as electronic cigarettes. The device control circuitry (processor circuitry) 28 may be considered to logically comprise various sub-units/circuitry elements associated with different aspects of the electronic cigarette's operation. For example, depending on the functionality provided in different implementations, the device control circuitry 28 may comprise power source control circuitry for controlling the supply of electrical power from the power source 14 to the aerosol generator 36, user programming circuitry for establishing configuration settings (e.g. user-defined power settings) in response to user input, as well as other functional units/circuitry associated functionality in accordance with the principles described herein and conventional operating aspects of electronic cigarettes. It will be appreciated the functionality of the device control circuitry 28 can be provided in various different ways, for example using one or more suitably programmed programmable computer(s) and/or one or more suitably configured application-specific integrated circuit(s)/circuitry/chip(s)/chipset(s) configured to provide the desired functionality.

The aerosol provision device 20 includes one or more air inlets 21. In use, as a user inhales on the mouthpiece 35, air is drawn into the aerosol provision device 20 through the air inlets 21 and along an air channel 23 to the aerosol generator 36, where the air mixes with the vaporized aerosol-generating material 32 and forms a condensation aerosol. The air drawn through the aerosol generator 36 continues along the air channel 23 to a mouthpiece 35, carrying some of the aerosol with it, and out through the mouthpiece 35 for inhalation by the user. Alternatively, the one or more air inlets 21 may be included on the article 30, such that the air channel 23 is entirely contained within the article 30.

By way of a concrete example, the article 30 comprises a housing (formed, e.g., from a plastics material), an aerosol-generating material storage area 39 formed within the housing for containing the aerosol-generating material 32 (which in this example may be a liquid which may or may not contain nicotine), an aerosol-generating material transfer component 37 (which in this example is a wick formed of e.g., glass or cotton fibers, or a ceramic material configured to transport the liquid from the reservoir using capillary action), an aerosol-generating area containing the aerosol generator 36, and a mouthpiece 35. Although not shown, a filter and/or aerosol modifying agent (such as a flavor imparting material) may be located in, or in proximity to, the mouthpiece 35. The aerosol generator 36 of this example comprises a heater element formed from an electrically resistive material (such as NiCr8020) spirally wrapped around the aerosol-generating material transfer component 37, and located in the air channel 23. The area around the heating element and wick combination is the aerosol-generating area of the article 30.

Figure 2:
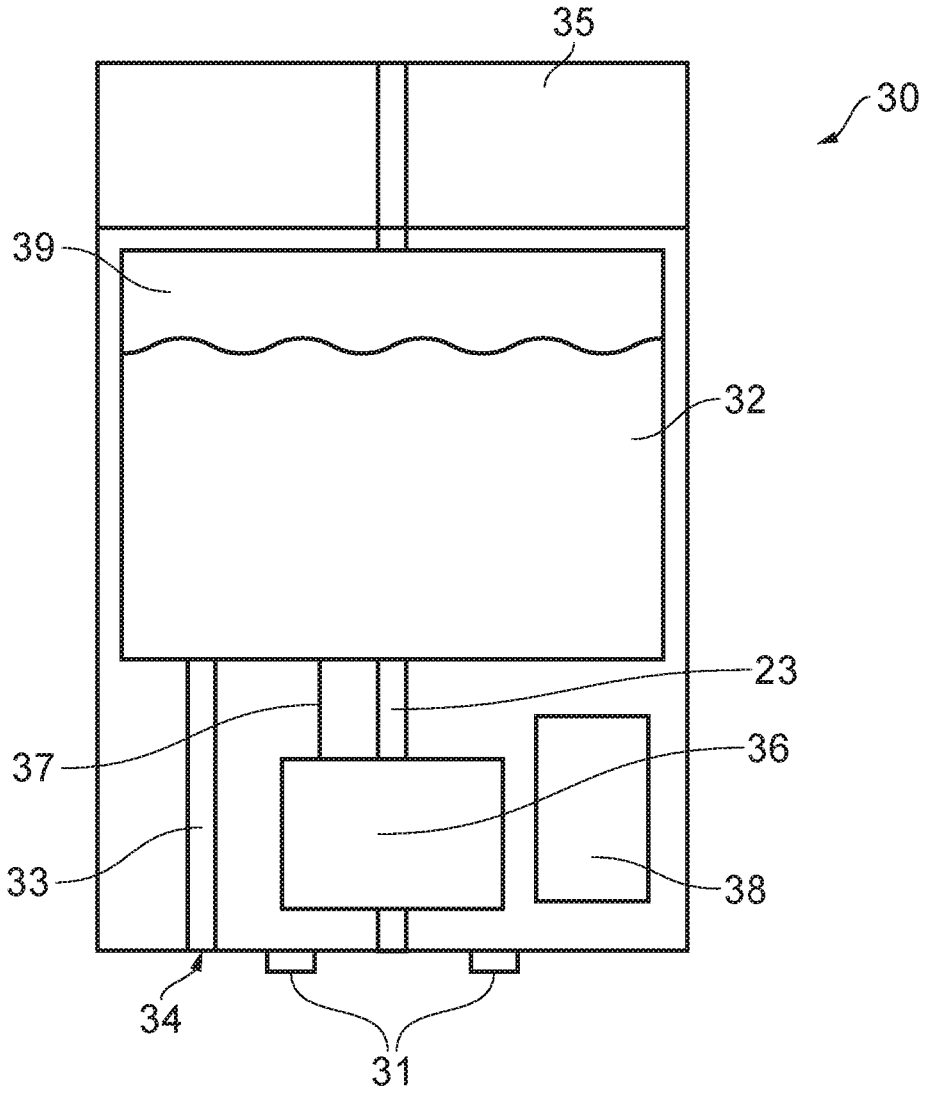
FIG. 2 is a schematic diagram of an example article for use in the aerosol provision system illustrated in FIG. 1.

FIG. 2 is a schematic diagram of an example article 30 for use in the aerosol provision system 10 illustrated in FIG. 1, where the same reference signs have been used for like elements between the article 30 illustrated in FIG. 1 and the article 30 illustrated in FIG. 2. As per the article 30 illustrated in FIG. 1, the article 30 illustrated in FIG. 2 includes an aerosol-generating material storage area 39 for storing an aerosol-generating material 32, an aerosol-generating material transfer component 37, an aerosol generation area containing an aerosol generator 36, and a mouthpiece 35.

The article 30 illustrated in FIG. 2 is configured to be refilled and reused. In other words, the aerosol-generating material storage area 39 of the article 30 illustrated in FIG. 2 can be refilled with aerosol-generating material 32 once some or all of the aerosol-generating material 32 contained in the aerosol-generating material storage area 39 has been exhausted or depleted. To facilitate the refilling or replenishment of aerosol-generating material 32, the article 30 has a refilling tube 33 extending between the aerosol-generating material storage area 39 and the exterior or an outer surface of the housing of the article 30, thereby creating a refilling orifice 34. Aerosol-generating material 32 can then be inserted into the aerosol-generating material storage area 39 via the refilling orifice 34 and refilling tube 33. It will be appreciated, however, that such a configuration of a refilling tube 33 and a refilling orifice 34 is not essential, and the article 30 may comprise any other suitable means of facilitating the refilling of the aerosol-generating material storage area 39 with aerosol-generating material 32.

The refilling orifice 34 and/or the refilling tube 33 may be sealable, for example with a cap or one-way valve, in order to ensure that aerosol-generating material 32 does not leak out of the refilling orifice 34. Although the refilling orifice 34 is illustrated in FIG. 2 as being on the same end or surface of the article 30 as the air channel 23 and interface with the aerosol provision device 20, this is not essential. The refilling orifice 34 may be located at the end of the article 30 comprising the mouthpiece 35, for example proximate to the outlet of the air channel 23 on the mouthpiece 35, such that the refilling tube 33 extends between the end of the article 30 comprising the mouthpiece 35 and the aerosol-generating material storage area 39. In this case, the article does not necessarily need to be separated from the aerosol provision device 20 in order to refill the article 30 with aerosol-generating material 32, as the refilling orifice 34 is not obstructed by the aerosol provision device 20 when the article 30 is coupled with the aerosol provision device 20.

The article 30 illustrated in FIG. 2 also comprises article control circuitry 38 configured to control the operation of the article 30 and store parameters and/or data associated with the article 30. The parameters associated with the article 30 may include, for example, a serial number and/or stock keeping unit (SKU) for the article 30 or other means of identifying the article 30 and/or the type of the article 30, a date of manufacture and/or expiry of the article 30, an indication of the number of times the article 30 has been refilled, the capacity of the aerosol-generating material storage area 39 and/or the amount of aerosol-generating material remaining in the aerosol-generating material storage area 39. As described above in relation to the device control circuitry 28, the article control circuitry 38 can be provided in various different ways, for example using one or more suitably programmed programmable computer(s) and/or one or more suitably configured application-specific integrated circuit(s)/circuitry/chip(s)/chipset(s) configured to provide the desired functionality. For example, the article control circuitry 38 may comprise a microcontroller unit (MCU) or a system on chip (SoC).

The article 30 illustrated in FIG. 2 also comprises one or more connectors 31, such as contact electrodes, connected via electrical wiring to the aerosol generator 36 and the article control circuitry 38. In use, the article 30 is coupled to the aerosol provision device 20 and the connectors 31 mate with connectors on the aerosol provision device, thereby allowing electrical power and electrical current to be supplied from the battery 14 of the aerosol provision device 20 to the aerosol generator 36 and the article control circuitry 38.

FIGS. 3A to 3F are further schematic diagrams of example articles 30 for use in the aerosol provision system 10 illustrated in FIG. 1, where the same reference signs have been used for like elements between the articles 30 illustrated in FIGS. 1 to 3. For ease of illustration, certain features of the article 30 have been omitted from FIGS. 3A to 3F, such as the aerosol-generating material storage area 39, aerosol-generating material 32 and mouthpiece 35, but it will be appreciated that the article 30 described with reference to FIGS. 3A to 3F may also contain some or all of these additional features illustrated in FIG. 2 but omitted from FIGS. 3A to 3F.

As illustrated in FIGS. 3A to 3F, there can be two connectors 31; an input (positive voltage) connector 31*a* and an output (negative voltage or ground) connector 31*b*. In use, when the article 30 is coupled to another device, such as the aerosol provision device 20 or a refilling device, electrical current is provided to the article 30 via the connectors 31*a*, 31*b* such that current is able to flow from the input connector 31*a* to both the article control circuitry 38 and aerosol generator 36 and then to the output connector 31*b*. Although there are two connectors 31*a*, 31*b* illustrated in FIGS. 3A to 3F, there may only be a single connector, such as a pin, jack, plug or socket connector that allows an input (positive voltage) wire and an output (negative voltage or ground) wire to be connected through the same connector 31.

There is a counter stored in the memory of the article control circuitry 38, and the article control circuitry 38 is configured to control the electrical power supplied to the aerosol generator 36 based on a value of a counter stored in memory of the article control circuitry 38. The value of the counter can indicate the number of inhalations (or puffs) performed on the article 30 forming part of the aerosol provision system 10 by the user of the aerosol provision system 10. This may also correspond to the number of activations of the aerosol generator 36; in other words, the number of times power was supplied to the aerosol generator 36, since the aerosol generator 36 is activated each time a user performs an inhalation on the aerosol provision system 10 in order to generate an aerosol for delivery to the user.

Figure 3A:
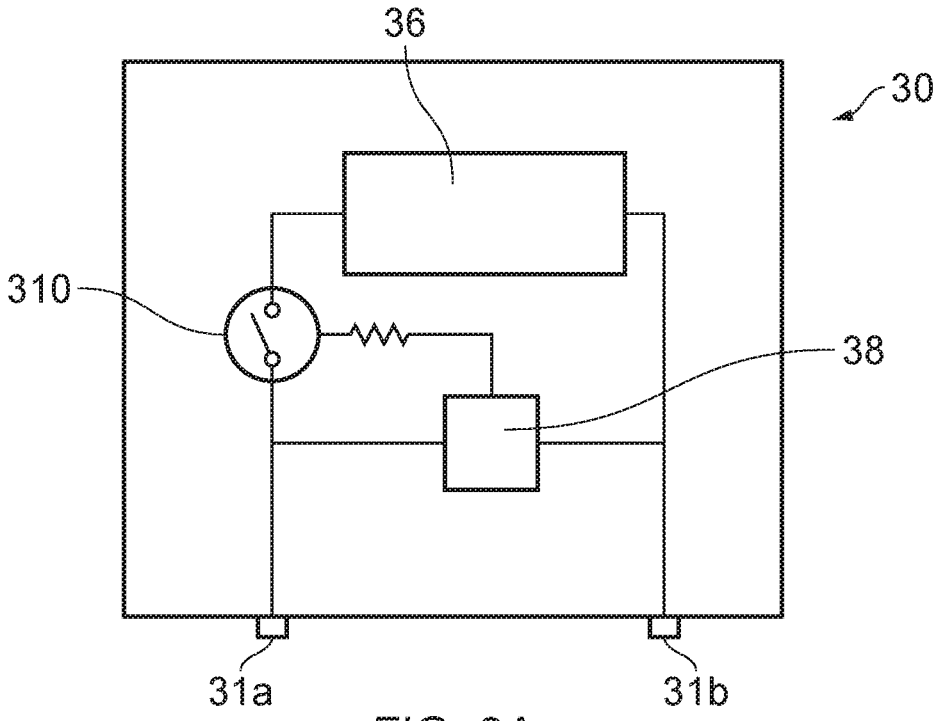
FIG. 3A is a schematic diagram of an example article for use in the aerosol provision system illustrated in FIG. 1.
Figure 3B:
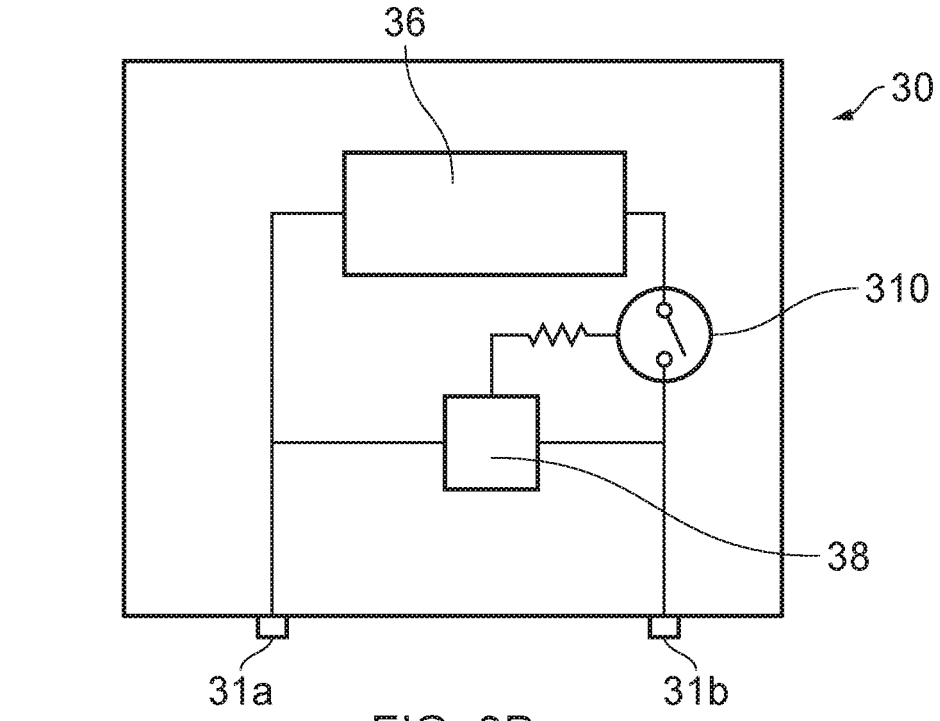
FIG. 3B is another schematic diagram of an article for use in the aerosol provision system illustrated in FIG. 1.
Figure 3C:
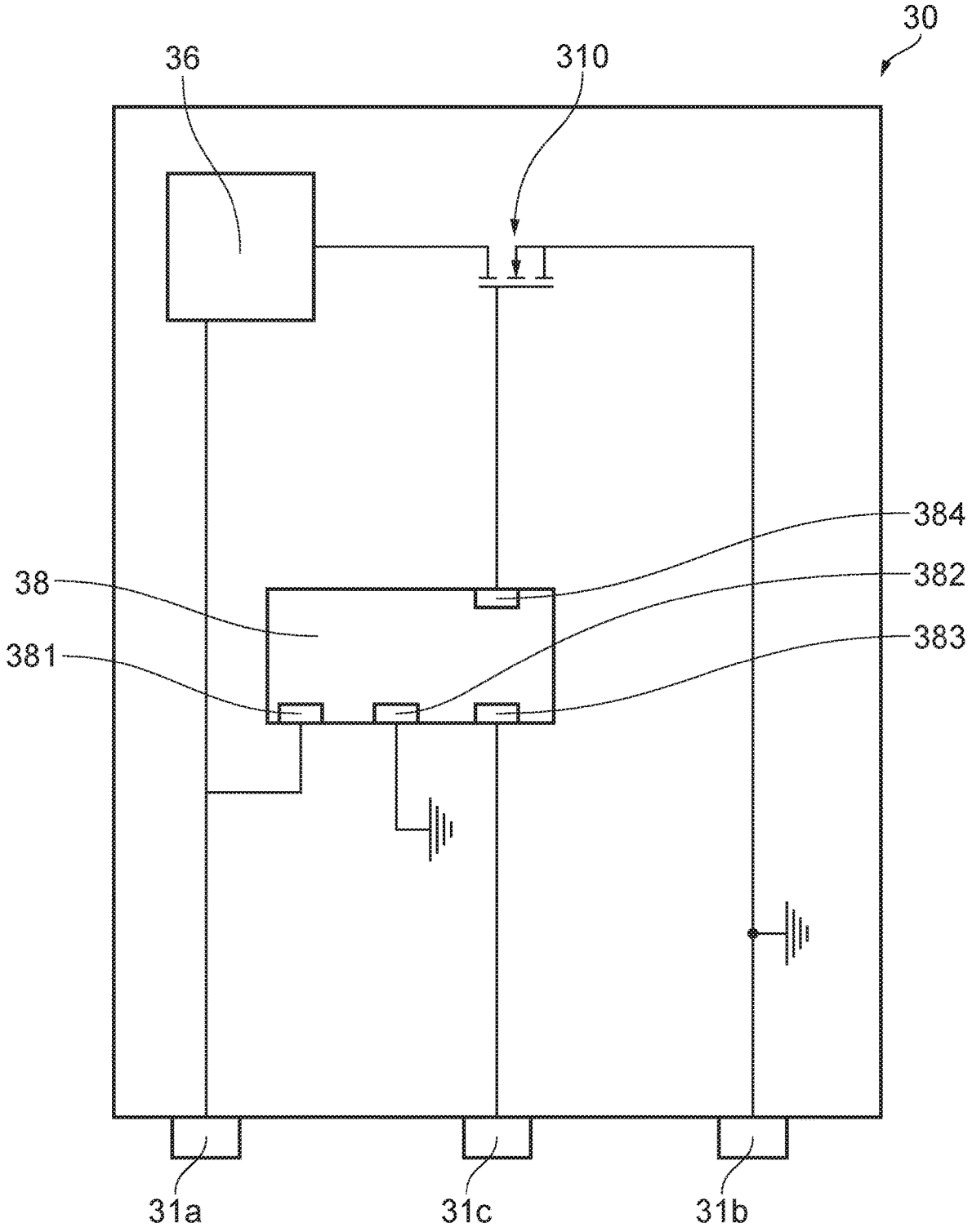
FIG. 3C is another schematic diagram of an article for use in the aerosol provision system illustrated in FIG. 1.

As illustrated in FIGS. 3A to 3F, the article 30 can also comprise a switch 310. In FIG. 3A the switch 310 is in series with and upstream (in other words on the input connector 31*a* side) of the aerosol generator 36, whilst in FIGS. 3B to 3F the switch 310 is in series with and downstream (in other words on the output connector 31*b* side) of the aerosol generator 36. In this case, the article control circuitry 38 is configured to control the electrical power supplied to the aerosol generator 36 by actuating the switch 310. In other words, the article control circuitry 38 is configured to actuate the switch to selectively enable or prevent electrical power from being supplied to the aerosol generator 36. In other words, the article control circuitry 38 enables the supply of electrical power to the aerosol generator 36 by closing the switch 310, thereby completing the circuit between the connectors 31*a*, 31*b* and the aerosol generator 36. The article control circuitry 38 then prevents the supply of electrical power to the aerosol generator 36 by opening the switch 310, thereby breaking the circuit between the connectors 31*a*. It will be appreciated, however, that other means of controlling the electrical power supplied to the aerosol generator 36 may be employed, such as through the use of logic gates, variable resistance and/or variable current.

As illustrated in FIGS. 3A to 3F, the article control circuitry 38 is on a separate circuit to (in other words, wired in parallel with) the switch 310 and the aerosol generator 36 so that electrical power can be supplied via the connectors 31*a*, 31*b* to the article control circuitry 38 regardless of whether the switch is open or closed. This means that, when the article 30 is coupled to another device, such as the aerosol provision device 20, the article control circuitry 38 can receive electrical power via the connectors 31*a*, 31*b* without having to activate the aerosol generator 36, since the switch 310 may be open when the article 30 is coupled to another device. The article control circuitry 38 can therefore receive electrical power independently of the aerosol generator 36.

Although in FIGS. 3A to 3F the switch 310 is illustrated as a separate component to the article control circuitry 38, the switch 310 may also be integrated into the article control circuitry 38 such that the switch 310 and the article control circuitry 38 form a single component, such as a microcontroller unit (MCU) or a system on chip (SoC) as described above.

The article control circuitry 38 can then be configured to update the value of the counter in response to an inhalation on the aerosol provision system 10 by a user of the aerosol provision system 10. The article control circuitry 38 may be configured to detect an inhalation, for example based on a sensor detecting a change in air pressure or airflow through the air channel 23, a sensor detecting the user's lips on the mouthpiece 35, and/or a sensor detecting a change in orientation of the article 30. Alternatively or in addition, the article control circuitry 38 may receive an indication from the device control circuitry 28 that an inhalation is being performed on the aerosol provision system 10 by the user of the aerosol provision system 10. In each case, the article control circuitry 38 is then configured to update the value of the counter in response to the inhalation. The value of the counter can be updated by incrementing or decrementing the value of the counter depending on the exact implementation of the counter, for example by a value of one for each inhalation performed by the user. A user may perform multiple inhalations within a short period of time, and the article control circuitry 38 may be configured to update the value of the counter periodically (for example every 10 seconds, every minute, 5 minutes or 10 minutes) to reflect the number of inhalations performed in that time period, rather than updating the counter in response to each inhalation.

The article control circuitry 38 can also be configured to prevent electrical power from being supplied to the aerosol generator 36 based on a comparison between the value of the counter and an inhalation limit. The inhalation limit represents the point at which the article 30 needs to be refilled. For example, there may be a maximum number of inhalations that can be performed on the aerosol provision system 10 by a user of the aerosol provision system 10 until the aerosol-generating material 32 in the aerosol-generating material storage area 39 is depleted and the article 30 needs to refilled (for example 50, 100, 500 or 1000). Providing electrical power to the aerosol generator 36 when there is little or no aerosol-generating material 32 in the aerosol-generating material storage area 39 can cause the aerosol generator 36 to dry out (as there is no aerosol-generating material 32 present to aerosolize) and/or cause the aerosol generator 36 to overheat, which could cause damage to the aerosol generator 36 or other components of the article 30 and aerosol provision system 10. To prevent this, the article control circuitry 38 can be configured to compare the value of the counter to an inhalation limit, and prevent electrical power from being supplied to the aerosol generator 36 when the inhalation limit has been reached, for example by actuating (opening) the switch 310, or maintaining the switch 310 in the open position. The inhalation limit can be set to either represent the maximum number of inhalations that can be performed on the aerosol provision system 10 by a user of the aerosol provision system 10 until the aerosol-generating material 32 in the aerosol-generating material storage area 39 is depleted (in other words, the aerosol-generating material storage area 39 is empty), or to represent fewer inhalations than the maximum number of inhalations that can be performed, such as 10, 50 or 100 inhalations fewer than then maximum number of inhalations that can be performed. In the latter cause, this ensures that electrical power is prevented from being supplied to the aerosol generator 36 before the aerosol-generating material 32 is completely depleted from the aerosol-generating material storage area 39, thereby preventing damage to the article 30 as well as preventing an adverse user experience, as the user is not able to perform an inhalation with little or no aerosol-generating material 32 present.

As described above, the value of the counter is updated in response to an inhalation on the aerosol provision system 10 by a user of the aerosol provision system 10. In the example described above where the value of the counter is updated by incrementing the value of the counter in response to an inhalation, the inhalation limit can equal (or be close to) the maximum number of inhalations that can be performed on the aerosol provision system 10 by a user of the aerosol provision system 10 until the aerosol-generating material 32 in the aerosol-generating material storage area 39 is depleted and the article 30 needs to refilled (for example 50, 100, 500 or 1000). When the value of the counter is reaches this inhalation limit, the article control circuitry 38 is configured to prevent electrical power from being supplied to the aerosol generator 36. Alternatively, in the example described above where the value of the counter is updated by decrementing the value of the counter in response to an inhalation is performed, the inhalation limit can equal zero, such that when the value of the counter has reached zero, the article control circuitry 38 is configured to prevent electrical power from being supplied to the aerosol generator 36.

The article control circuitry 38 can be further configured to update the value of the counter to a reset value in response to the article 30 being filled with aerosol-generating material 32. As described above, the article 30 can be filled and refilled with aerosol-generating material 32, for example by a refilling device. The article control circuitry 38 can be configured to determine that the article 30 (more specifically the aerosol-generating material storage area 39) has been filled with aerosol-generating material 32, and update the value of the counter to a reset value as a result. For example, the article control circuitry 38 may be configured to use a sensor or gauge in or proximate to the aerosol-generating material storage area 39 to detect an increase in the amount of aerosol-generating material 32 in the aerosol-generating material storage area 39, thereby indicated that the article 30 has been filled with aerosol-generating material 32. Alternatively, the article control circuitry 38 may receive a notification from a refilling device indicating that the article 30 has been coupled to the refilling device and that aerosol-generating material 32 has been transferred to the aerosol-generating material storage area 39 by the refilling device. The article control circuitry 38 can then update the value of the counter to the reset value in response to receiving the notification.

In response to determining that the article 30 has been filled with aerosol-generating material 32, the article control circuitry 38 can update the value of the counter to a reset value. For example, in the case described above where the value of the counter is incremented in response to an inhalation on the aerosol provision device 10 by the user of the aerosol provision device 10, the reset value can be zero, and the article control circuitry 38 is then configured to update the value of the counter to zero. Alternatively, in the case described above where the value of the counter is decremented in response to an inhalation on the aerosol provision device by the user of the aerosol provision device 10, the reset value could be equal to (or close to) the maximum number of inhalations that can be performed on the aerosol provision system 10 by a user of the aerosol provision system 10 until the aerosol-generating material 32 in the aerosol-generating material storage area 39 is depleted, and the article control circuitry 38 is then configured to update the value of the counter to the reset value In other words, updating the value of the counter to the reset value provides an indication that the article 30 has been refilled with aerosol-generating material 32.

In some cases, the article 30 is not completely filled with aerosol-generating material 32. In other words, aerosol-generating material 32 is transferred to the aerosol-generating material storage area 39, but the aerosol-generating material storage area 39 does not reach its capacity. In this case, the article control circuitry 38 can update the value of the counter to a reset value that reflects the amount of aerosol-generating material 32 in the aerosol-generating material storage area 39. In other words, the reset value is selected by the article control circuitry 38 based on the amount of aerosol-generating material 32 transferred to the aerosol-generating material storage area 39 so that the number of inhalations required before the value of the counter reaches the inhalation limit is reflective of the amount of aerosol-generating material 32 in the aerosol-generating material storage area 39. The article control circuitry 38 can be configured to determine the amount of aerosol-generating material 32 transferred to the aerosol-generating material storage area 39 using similar methods as described above, such as using a sensor or receiving a notification from the refilling device indicating the amount of aerosol-generating material 32 that was is transferred to the aerosol-generating material storage area 39.

The article control circuitry 38 can also be configured to enable the supply of electrical power to the aerosol generator 36 in response to the value of the counter being updated to the reset value. Since updating the value of the counter to the reset value indicates that aerosol-generating material 32 has been transferred into the aerosol-generating material storage area 39, it is therefore safe to supply electrical power to the aerosol generator 36. Accordingly, the article control circuitry 38 can be configured to enable the supply of electrical power to the aerosol generator 36 in response to the value of the counter being updated to the reset value, for example by closing the switch 310. It will be appreciated, however, that by enabling the supply of electrical power to the aerosol generator 36, this does not necessarily mean that the aerosol generator 36 is continuously supplied with electrical power in response to the value of the counter being updated to the reset value, and electrical power may still only be supplied to the aerosol generator 36 in response to a signal. For example, the article control circuitry 38 may enable the supply of electrical power to the aerosol generator 36 such that, as described above, the aerosol generator 36 is still only supplied with electrical power in response to an inhalation on the aerosol provision system 10 by a user of the aerosol provision system 10.

In the example illustrated in FIGS. 3A to 3F, in response to the device control circuitry 28 sending an indication to the article control circuitry 38 that an inhalation has been detected, the article control circuitry 38 may read the value of the counter. If the value of the counter equals the reset value, or indicates that the inhalation value has not been reached, then the article control circuitry 38 can actuate (close) the switch 310, thereby enabling the supply of electrical power to the aerosol generator 36. For example, the device control circuitry 28 may be configured to enable the supply of electrical power from the battery 14 to the article control circuitry 38 in response to detecting an inhalation on the aerosol provision system 10 by a user of the aerosol provision system. The article control circuitry 38 is then configured to receive the electrical power from aerosol provision device 20 coupled to the article 30. The article control circuitry 38 then reads the value of the counter and determines whether to enable the supply of electrical power to the aerosol generator 36 from the aerosol provision device 20 based on the value of the counter. As described above, if the value of the counter is equal to the reset value or has not reached the inhalation limit, the article control circuitry 38 enables the supply of electrical power to the aerosol generator 36 (for example by closing the switch 310). If the value of the counter is equal to (i.e., as reached) the inhalation limit, the article control circuitry 38 prevents the supply of electrical power to the aerosol generator 36 (for example by opening the switch 310).

Alternatively, the article control circuitry 38 may actuate (close) the switch 310 in response to the value of the counter being updated to the reset value, but the device control circuitry 28 is configured to only enable the supply of electrical power from the battery 14 to the aerosol generator 36 in response to detecting an inhalation. The device control circuitry 28 may enable the supply of electrical power from the battery 14 to the aerosol generator 36 by actuating a second switch separate to the switch on the article 30 (for example location on the aerosol provision device 20). In this way, electrical power is only supplied from the battery 14 to the aerosol generator 36 when both the switch 310 controlled by the article control circuity 38 and the switch controlled by the device control circuitry 28 are closed. As described above, this means that when the article control circuitry 38 prevents electrical power from being supplied to the aerosol generator 36, for example by opening the switch 310, the aerosol generator 36 does not receive electrical power from the battery 14, even in response to the device control circuitry 28 detecting an inhalation and closing the second switch.

An initial value of the counter may indicate that the article 30 is new. In other words, when the article 30 is manufactured, the value of the counter is set to an initial value to indicate that the article 30 has not been used a part of an aerosol provision system 10 before. The initial value of the counter represents a special value, such as −1 or a value exceeding the maximum number of inhalations that can be performed on the aerosol provision system 10 by a user of the aerosol provision system 10 until the aerosol-generating material 32 in the aerosol-generating material storage area 39 is depleted and the article 30 needs to refilled, such that the initial value falls outside of the range of the counter described above.

Some refillable articles 30 are manufactured and sold without aerosol-generating material 32 in the aerosol-generating material storage area 39 (in other words, the aerosol-generating material storage area 39 is empty). In this case, the initial value of the counter also indicates that there is no aerosol-generating material 32 in the aerosol-generating material storage area 39. The article control circuitry 38 can be configured to prevent electrical power from being supplied to the aerosol generator 36 in response to determining that the value of the counter equals the initial value, for example by actuating (opening) the switch 310, or my maintaining the switch 310 in the open position. In other words, when the article 30 is new the aerosol generator 36 is disabled and cannot be used until the value of the counter is updated away from the initial value. Preventing electrical power from being supplied to the aerosol generator 36 when the value of the counter equals the initial value ensures that the article 30 cannot be used when the aerosol-generating material storage area 39 is empty, which could damage the aerosol generator 36 or other components of the article 30 and aerosol provision device 20.

As described above, the value of the counter is updated to the reset value in response to the article being filled aerosol-generating material 32. Accordingly, when a new article 30 where the value of the counter is equal to the initial value is filled aerosol-generating material 32, the value of the counter is updated to the reset value, thereby indicating that the article 30 has been filled with filled aerosol-generating material 32 and that the aerosol generator 36 can be enabled.

Alternatively, a new article 30 may be supplied with aerosol-generating material 32 in the aerosol-generating material storage area 39, but require the user to connect the article 30 to a refilling device in order for the value of the counter to be updated away from the initial value (for example to the reset value). This therefore ensures that the article 30 is connected to an approved refilling device before the aerosol generator 36 can be enabled, thereby reducing misuse of the article 30.

Once the value of the counter has been updated from the initial value, the article control circuitry 38 is configured to ensure the value of the counter does not equal the initial value again, thereby providing an indication that the article 30 is no longer new.

In some examples, there is a second counter stored in memory of the article control circuitry 38. In this case, the article control circuitry 38 is configured to update a value of the second counter in response to an inhalation on the aerosol provision system by a user of the aerosol provision system. In a similar fashion to as described above in relation to the first counter, the value of the second counter may be updated by incrementing or decrementing the second counter in response to an inhalation on the aerosol provision system 10 by a user of the aerosol provision system 10.

The value of the second counter is an indication of the total number of inhalations that have been performed on the article 30 (in other words, the number of times the aerosol generator 36 has been enabled) since the article 30 was manufactured/new. Accordingly, the article control circuitry 38 can be configured maintain the value of the second counter in response to the article being filled aerosol-generating material 32. In other words, unlike the value of the first counter that is updated to the reset value when the article 30 is filled aerosol-generating material 32, the value of the second counter is not changed or updated by the article control circuitry 38 when the article 30 is filled aerosol-generating material 32. The value of the second counter is therefore independent of the number of times the article 30 has been filled/refilled with aerosol-generating material 32.

The article control circuitry 38 can be configured to permanently prevent electrical power from being supplied to the aerosol generator 36 based on a comparison between the value of the second counter and a usage limit. The usage limit represents the end of the usable life of the article 30, such that when the value of the second counter reaches or equals the usage limit, the electrical power is permanently prevented from being supplied to the aerosol generator 36 such that the article can no longer be used for generating aerosol. Electrical power may be permanently prevented from being supplied to the aerosol generator 36 by opening the switch 310, or through another means of interrupting the circuit to the aerosol generator 36 such as a circuit breaker, fuse or a second switch.

In the case where the value of the second counter is incremented in response to an inhalation on the aerosol provision system 10 by a user of the aerosol provision system 10, the value of the second counter represents the number of inhalations (and number of times the aerosol generator has been enabled) since the article 30 was first manufactured (ie when the article 20 was new. In this case, the usage limit equals the number of inhalations (and number of times the aerosol generator has been enabled) the article 30 is designed or intended to be used for, such as 1000, 10000, 50000 or more. The article control circuitry 38 is then configured to permanently prevent the supply of electrical power to the aerosol generator 36 when the value of the second counter reaches or equals the usage limit.

Alternatively, when the article 30 is first manufactured (i.e., when the article is new), the value of the second counter equals the number of inhalations (and number of times the aerosol generator has been enabled) the article 30 is designed or intended to be used for. The value of the second counter is then decremented in response to an inhalation on the aerosol provision system 10 by a user of the aerosol provision system 10. In this case, the usage limit equals zero, such that electrical power is permanently prevent from being supplied to the aerosol generator 36 when the value of the second counter equals (or reaches) zero.

The number of inhalations (and number of times the aerosol generator has been enabled) the article 30 is designed or intended to be used for is defined or set based on a number of factors, such as the degradation and reliability of components within the article 30, such as the aerosol generator 36 and aerosol-generating material transfer component 37. The inhalation limit (and/or the number of inhalations the article 30 is designed or intended to be used for) can therefore be defined or set in order to ensure safe, reliable and consistent operation of the article 30, and that the article 30 is replaced before the article 30 adversely impacts the operation of the aerosol provision system 10.

The articles illustrated in FIGS. 3C to 3F have one or more data connectors 31*c* electrically coupled to the article control circuitry 38. The article 30 illustrated in FIGS. 6C to 6F have a single data connector 31*c*, but it will be appreciated that the article 30 may have more data connectors, for example two or four data connectors. The data connector 31*c* facilitates the transfer of data between the article control circuitry 38 and a device, such as the aerosol provision device 20, when the device is coupled to the connectors 31*a*, 31*b* and the data connectors, 31*c*, 31*d*. In other words, when a device (such as the aerosol provision device 20) is coupled to the article 30, the connectors 31*a*, 31*b* mate with power connectors on the aerosol provision device thereby allowing electrical power and electrical current to be supplied from the battery 14 of the aerosol provision device 20 to the aerosol generator 36 and the article control circuitry 38 via the connectors 31*a*, 31*b*, whilst the data connectors 31*c* mate with data connectors of the aerosol provision device 20, thereby allowing the transfer of data between the article control circuitry 38 and the device control circuitry 28 via the data connectors 31*c*. Accordingly, in the article 30 illustrated in FIGS. 3C to 3F, data can be transferred to and from the article control circuitry 38 via different connectors to the connectors via which electrical power is supplied to the aerosol generator 36 and the article control circuitry 38. Alternatively, or in addition, data can be transferred using the connectors 31*a*, 31*b* such as in the article 30 illustrated in FIGS. 3A and 3B.

Having separate data connectors 31*c* for transferring data between the article control circuitry 38 and a device coupled to the article 30 means that the input voltage at the input connector 31*a* for supplying electrical power to the aerosol generator 36 and the article control circuitry 38 is not altered or fluctuated when data is transferred to and from the article control circuitry 38. This allows a constant voltage to be supplied to the aerosol generator 36 and the article control circuitry 38 at the same time as transferring data between the article control circuitry 38. For example, when the article 30 is coupled to the aerosol provision device 20, data can be transferred between the article control circuitry 38 and the device control circuitry 28 via the data connectors 31*c* at the same time as the aerosol generator 36 is activated via the connectors 31*a*, 31*b*, such as during an inhalation on the mouthpiece 35 by a user of the aerosol provision system 10.

When the article 30 is connected to a refilling device, electrical power does not need to be supplied to the aerosol generator 36. For the articles 30 illustrated in FIGS. 3C to 3F, the article control circuitry 38 can exchange data with the refilling device whilst preventing electrical power from being supplied to the aerosol generator 36, but in this case the data can be transmitted via the data connectors 31*c* whilst the article control circuitry 38 receives electrical power via connectors 31*a*, 31*b*. As described above, the switch 310 is kept open, however, to prevent the supply of electrical power to the aerosol generator 36.

As described above, the article control circuitry 38 may comprise integrated circuit(s)/circuitry/chip(s)/chipset(s) configured to provide the functionality described herein. The article control circuitry 38 illustrated in FIGS. 3C to 3F is an integrated circuit with four connectors 381-384. As described above, the first connector 381 is the positive supply voltage (VCC), whilst the second connector 382 is the ground connector. The third connector 383 and fourth connector 394 are input/output connectors, with the third connector 383 connected to the data connector 31*c* to enable data transfer whilst the fourth connector 384 is connected to the switch 310 to enable the article control circuitry 38 to actuate the switch 310 as described above. In particular, the fourth connector 384 is located inside the article 30 and is not directly connected to any of the connectors 31*a*, 31*b*. This means the fourth connector 384 cannot be easily accessed by the user of the aerosol-provision device 10, thereby making it harder for the user to tamper with the article 30, for example the user is not able to supply electrical power to the aerosol generator 36 whilst bypassing the article control circuitry 38. This results in a more robust, tamper resistant article 30.

Figure 3D:
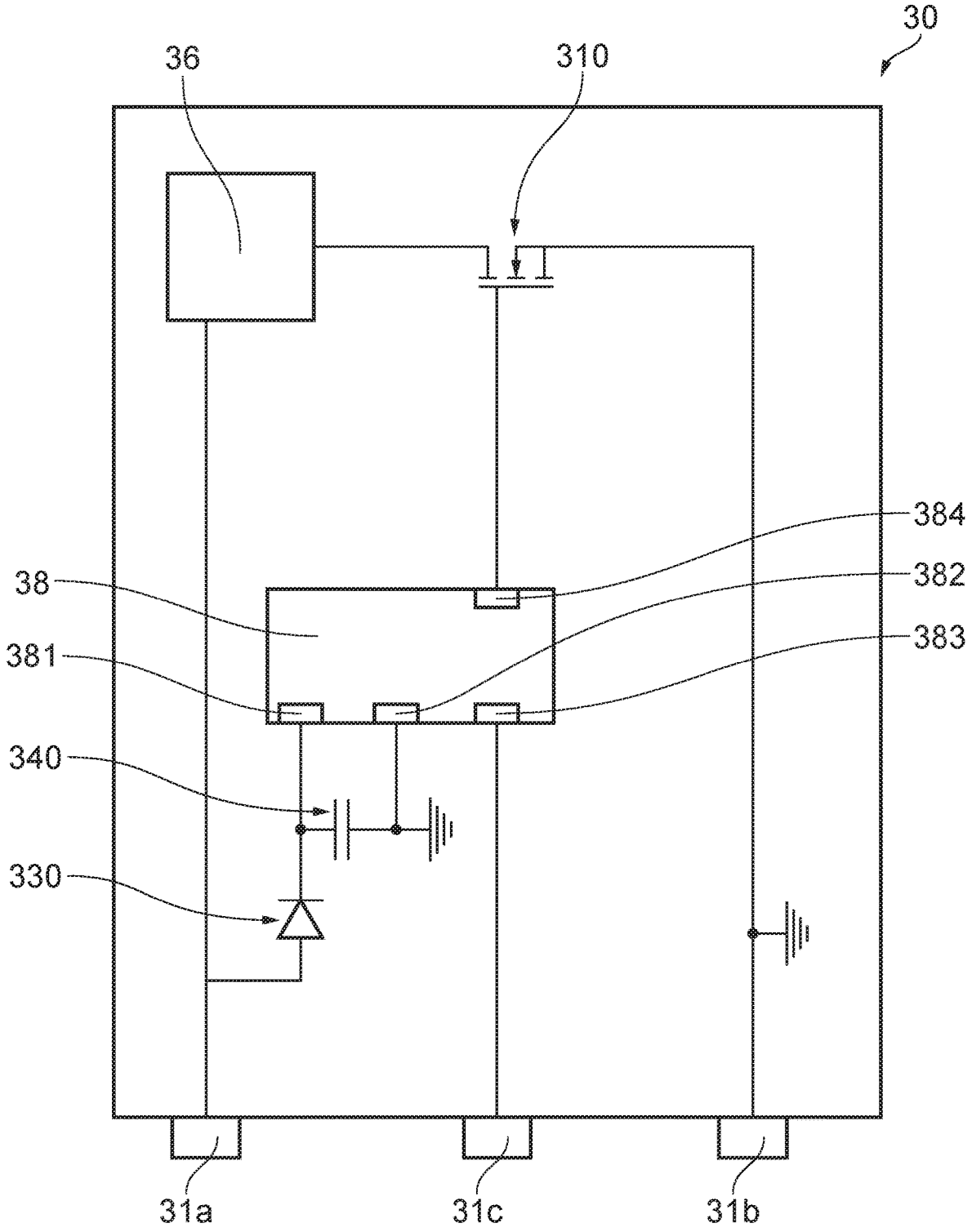
FIG. 3D is another schematic diagram of an article for use in the aerosol provision system illustrated in FIG. 1.
Figure 3E:
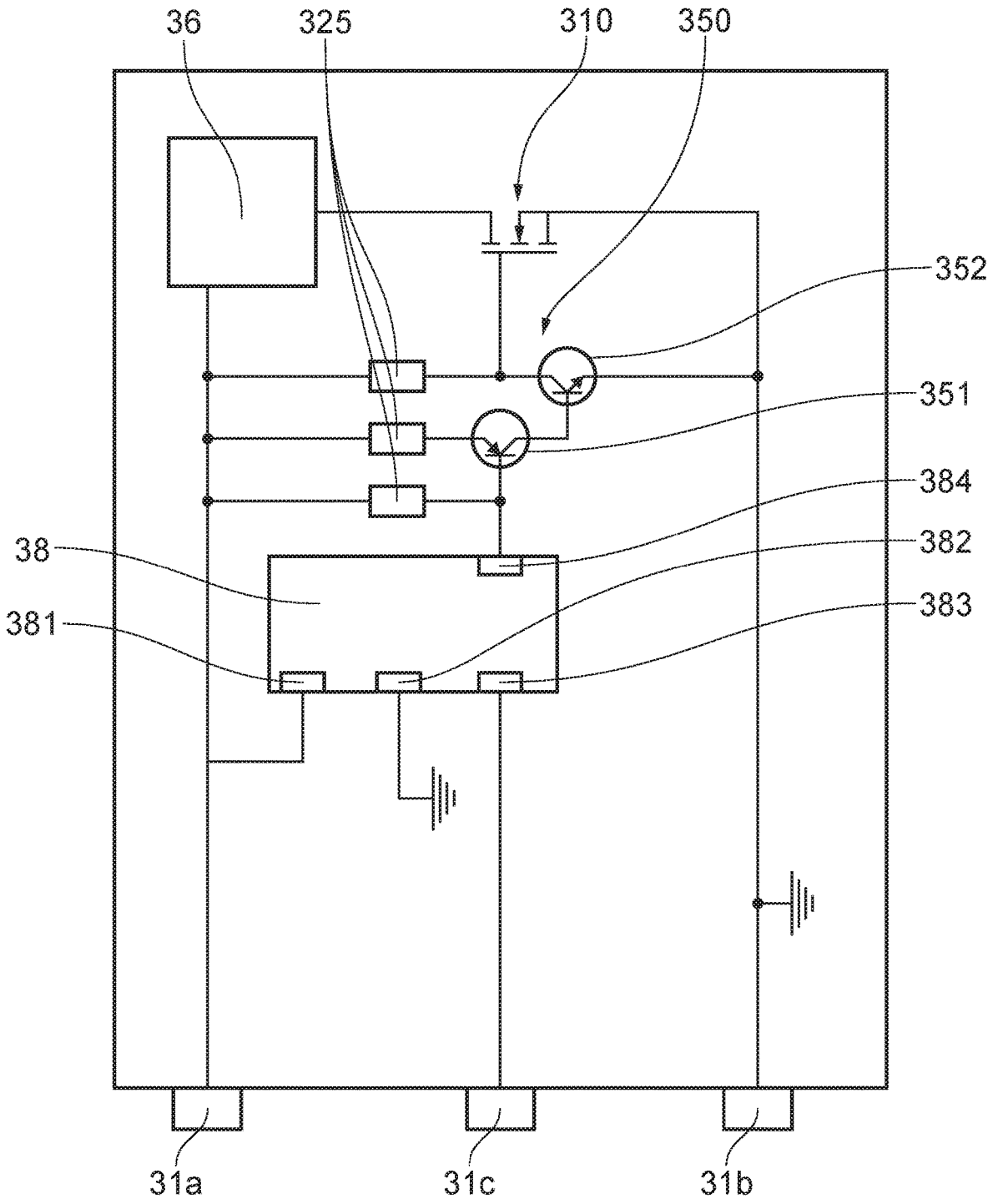
FIG. 3E is another schematic diagram of an article for use in the aerosol provision system illustrated in FIG. 1.
Figure 3F:
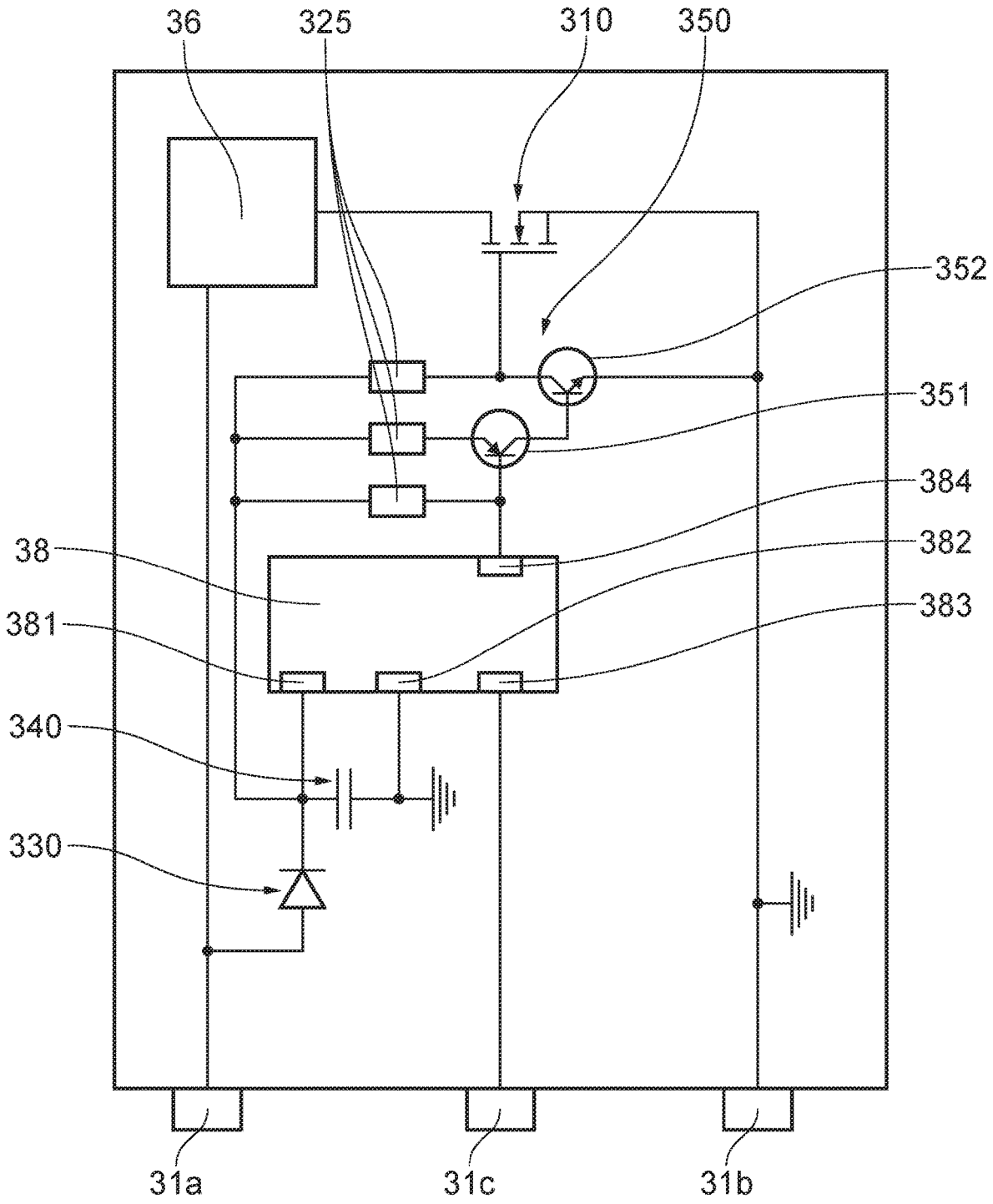
FIG. 3F is another schematic diagram of an article for use in the aerosol provision system illustrated in FIG. 1.

The article 30 illustrated in FIGS. 3D and 3F has a diode 330 between the connector 31*a* and the article control circuitry 38 (i.e. the first connector 381) to control the direction of current through the article control circuitry 38. The article illustrated in FIGS. 3D and 3F also comprises one or more capacitors 340 between the first connector 381 and the second connector 382 to act as a power rectifier such that voltage can be supplied to the article control circuitry 38 when the connectors 31*a*, 31*b* are not electrically connected to either the aerosol provision device 20 or a refilling device. This also prevents the value of the first counter and the second counter stored in the memory of the article control circuitry 38 from being erroneously changed due to the input voltage to the article control circuitry 38 falling to zero. This ensures that the counter and the article control circuitry 38 continue to function in their intended fashion, and in particular that the article 30 cannot be used once the value of the first counter has reached or exceeded the inhalation limit and/or when the value of the second counter has reached or exceeded the usage limit.

The article 30 illustrated in FIGS. 3E and 3F has a Sziklai pair 350 between the fourth connector 384 and the switch 310. A Sziklai pair 350 comprises a pair of bipolar transistors 351, 352; the first transistor 351 is a PNP transistor and the second transistor 352 is a NPN transistor. There is also a resistor 325 on each of the lines between the voltage line to the heater and the transistors 351, 352 of the Sziklai pair 350. The Sziklai pair 350 is used to control the supply of electrical power to the aerosol generator 36, in particular to pickup the output from the fourth connector 384 since the fourth connector 384 may have a low power output. As illustrated in FIG. 3F, when the Sziklai pair 350 used in combination with the power rectifier (diode 330 and capacitor 340), the voltage line into the heater 36 is entirely separate from the line between the fourth connector 384 and the switch 310.

Figure 4:
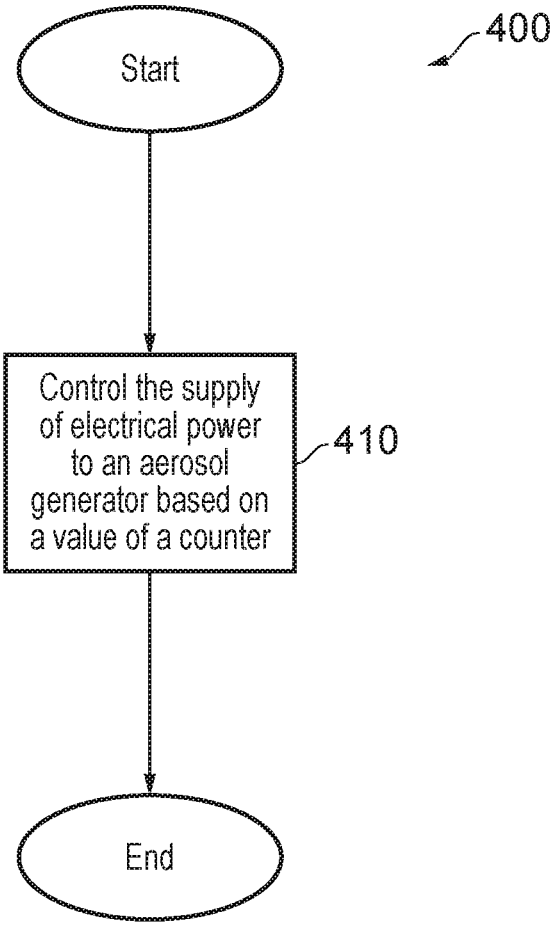
FIG. 4 is a flow chart of a method of controlling an article for an aerosol provision system.

FIG. 4 is a flow chart of a method 400 of controlling an article 30 for an aerosol provision system 10, for example performed by the article control circuitry 38. At 410 the supply of electrical power to an aerosol generator is controlled based on a value of a counter. The method then ends.

Figure 5:
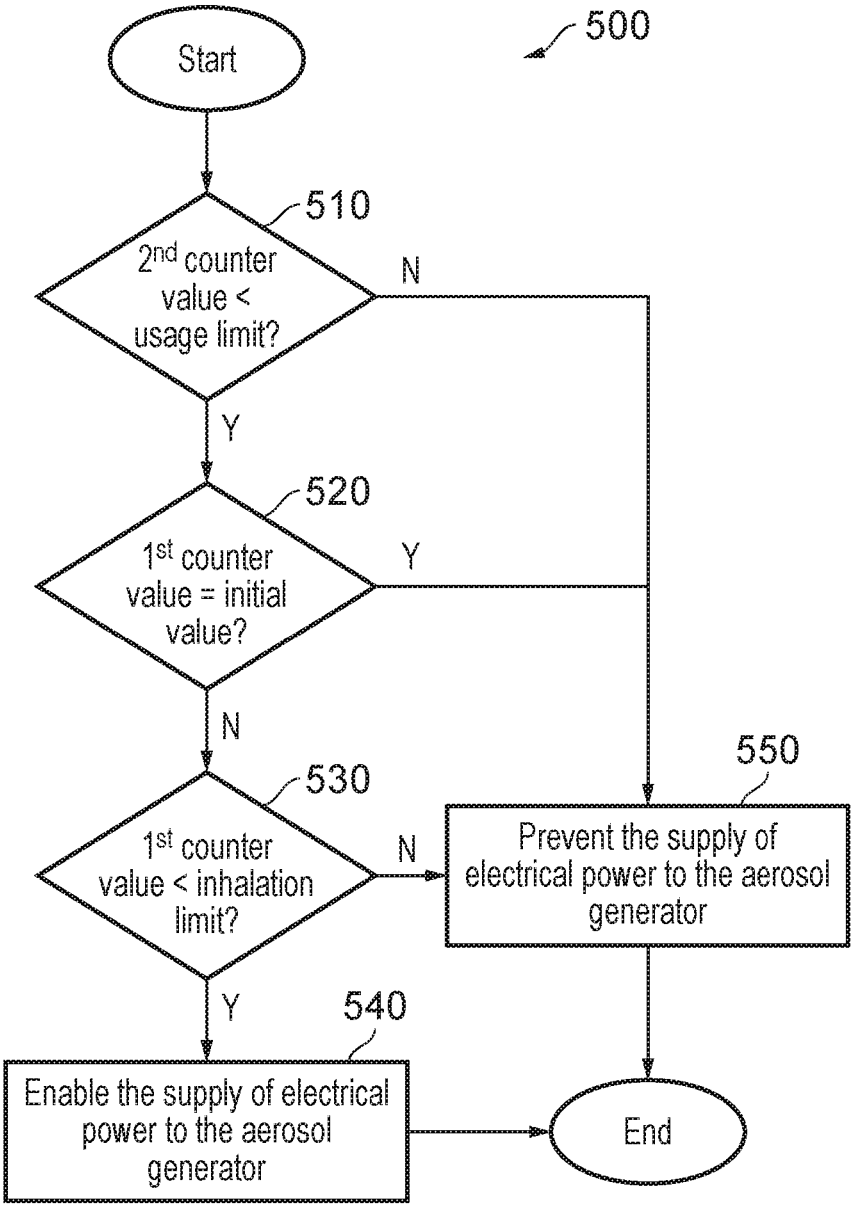
FIG. 5 is a flow chart of a further method of controlling an article for an aerosol provision system.

FIG. 5 is a flow chart of a further method 500 of controlling an article 30 for an aerosol provision system 10, for example performed by the article control circuitry 38. The method begins at 510, where it is determined whether the value of a second counter is less than a usage limit. If the value of the second counter is not less than the usage limit the method proceeds to 550, where the supply of electrical power to the aerosol generator 36 is prevented, for example by opening switch 310 or maintaining 310 in an open position. The method then ends. If at 510 it is determined that the value of the second counter is less than the usage limit, the method proceeds to 520, where it is determined whether the value of a first counter is equal to an initial value. If the value of the first counter is equal to the initial value the method proceeds to 550, where the supply of electrical power to the aerosol generator 36 is prevented, for example by opening switch 310 or maintaining 310 in an open position. The method then ends. If at 520 it is determined that the value of the first counter is not equal to the initial value, the method proceeds to 530, where it is determined whether the value of a first counter is less than an inhalation limit. If the value of the first counter is not less than the inhalation limit the method proceeds to 550, where the supply of electrical power to the aerosol generator 36 is prevented, for example by opening switch 310 or maintaining 310 in an open position. The method then ends. If at 530 it is determined that the value of the first counter is not equal to the initial value, the method proceeds to 540, where the supply of electrical power to the aerosol generator 36 is enabled, for example by closing switch 310. The method then ends.

Figure 6:
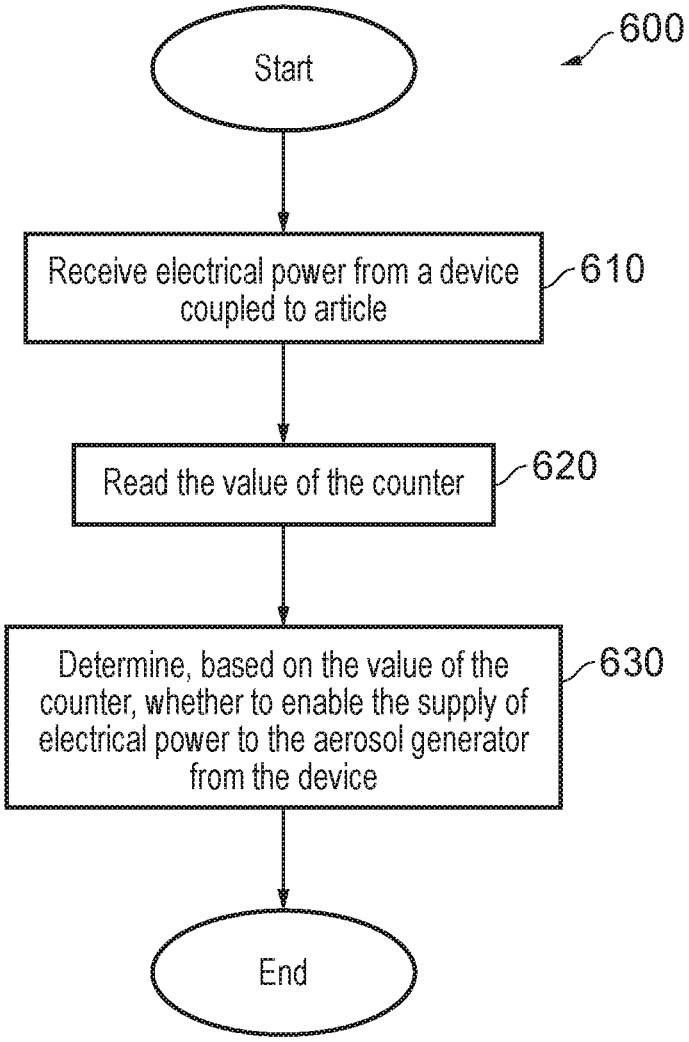
FIG. 6 is a flow chart of a method of controlling an aerosol generator of an article for an aerosol provision system.

FIG. 6 is a flow chart of a method 600 of controlling an aerosol generator 36 of an article 30 for an aerosol provision system 10, for example performed by the article control circuitry 38. The method begins at 610, where electrical power is received from a device coupled to the article 30, such as the aerosol provision device 20. For example, as described above, electrical power may be received from the battery 14 of the aerosol provision device 20 in response to the device control circuitry 28 detecting an inhalation on the aerosol provision system 10 by a user of the aerosol provision system 10. At 620, the value of the counter is read. At 630, a determination is made, based on the value of the counter, whether to enable the supply of electrical power to the aerosol generator 36 from the device 20, for example using the method 400 or the method 500. In the case of method 500, the counter of method 600 is the first counter of method 500, and the value of the second counter is also read at 620. The method then ends.

The methods 400, 500, 600 illustrated in FIGS. 4, 5 and 6 may be stored as instructions on a computer readable storage medium, such that when the instructions are executed by a processor, the methods 400, 500, 600 described above are performed. The computer readable storage medium may be non-transitory.

As described above, the present disclosure relates to (but it not limited to) an article for an aerosol provision system comprising an aerosol generator and article control circuitry configured to control electrical power supplied to the aerosol generator based on a value of a counter stored in memory of the article control circuitry.

Thus, there has been described an article for an aerosol provision system, an aerosol provision system, a method of controlling an article for an aerosol provision device and a method of controlling an aerosol generator of an article for an aerosol provision device.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of that which is claimed. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method of controlling an aerosol generator of an article for an aerosol provision system comprising:

receiving electrical power from a device coupled to the article;

reading a value of a counter; and determining, based on the value of the counter, whether to enable a supply of the electrical power to the aerosol generator from the device, comprising preventing the electrical power from being supplied to the aerosol generator in response to determining that the value of the counter equals an initial value, wherein the initial value indicates that the article is new.

2. A method of controlling an article for an aerosol provision system comprising:

controlling electrical power supplied to an aerosol generator based on a value of a counter; and preventing the electrical power from being supplied to the aerosol generator in response to determining that the value of the counter equals an initial value, wherein the initial value of the counter indicates that the article is new.

3. The method of claim 2, further comprising:

updating the value of the counter in response to an inhalation on the aerosol provision system by a user of the aerosol provision system.

4. The method of claim 2, further comprising:

preventing the electrical power from being supplied to the aerosol generator based on a comparison between the value of the counter and an inhalation limit.

5. The method of claim 2, further comprising:

updating the value of the counter to a reset value in response to the article filling with aerosol-generating material.

6. The method of claim 5, further comprising:

enabling the supply of the electrical power to the aerosol generator in response to the value of the counter being updated to the reset value.

7. An article for an aerosol provision system comprising:

an aerosol generator; and article control circuitry configured to control electrical power supplied to the aerosol generator based on a value of a counter stored in memory of the article control circuitry, wherein the article control circuitry is configured to prevent the electrical power from being supplied to the aerosol generator in response to determining that the value of the counter equals an initial value, wherein the initial value indicates that the article is new.

8. The article of claim 7, wherein the article control circuitry is configured to update the value of the counter to a reset value in response to the article filling with aerosol-generating material.

9. The article of claim 7, wherein the article control circuitry is configured to enable the supply of the electrical power to the aerosol generator in response to the value of the counter being updated to the reset value.

10. The article of claim 7, wherein the article control circuitry is configured to update the value of the counter in response to an inhalation on the aerosol provision system by a user of the aerosol provision system.

11. The article of claim 7, wherein the article control circuitry is configured to prevent the electrical power from being supplied to the aerosol generator based on a comparison between the value of the counter and an inhalation limit.

12. An aerosol provision system comprising the article of claim 7.

13. The article of claim 7, further comprising a switch, wherein the article control circuitry is configured to control the electrical power supplied to the aerosol generator by actuating the switch.

14. The article of claim 13, wherein the switch is integrated into the article control circuitry.

15. The article of claim 7, further comprising a second counter stored in the memory of the article control circuitry, wherein the article control circuitry is configured to update a value of the second counter in response to an inhalation on the aerosol provision system by a user of the aerosol provision system.

16. The article of claim 15, wherein the article control circuitry is configured maintain the value of the second counter in response to the article being filled with aerosol-generating material.

17. The article of claim 15, wherein the article control circuitry is configured to permanently prevent the electrical power from being supplied to the aerosol generator based on a comparison between the value of the second counter and a usage limit.

* * * * *